US005700356A

United States Patent [19]

Lefkowitz

[11] Patent Number: 5,700,356

[45] Date of Patent: Dec. 23, 1997

[54] AIR PERMEABLE BELT FOR DEWATERING WEB IN PRESS NIP

[76] Inventor: Leonard R. Lefkowitz, 14 Alpine Dr., Latham, N.Y. 12110

[21] Appl. No.: 582,345

[22] Filed: Jan. 19, 1996

[51] Int. Cl.[6] ..... D21F 3/00

[52] U.S. Cl. ..... 162/358.1; 162/358.2; 162/900; 428/131; 428/137; 428/156

[58] Field of Search ..... 162/358.2, 358.1, 162/358.4, 900, 901, 903; 428/131, 156, 137, 310.5

[56] References Cited

U.S. PATENT DOCUMENTS

| | | | |
|---|---|---|---|
| 2,114,072 | 4/1938 | Cleveland . | |
| 3,477,906 | 11/1969 | Rabstad . | |
| 3,655,507 | 4/1972 | Nykopp | 162/358.1 |
| 3,928,699 | 12/1975 | Fekete | 428/212 |
| 4,446,187 | 1/1984 | Eklund | 162/900 |
| 4,482,430 | 11/1984 | Majaniemi | 162/901 |
| 4,526,655 | 7/1985 | Karvinen et al. | 162/360.2 |
| 4,535,611 | 8/1985 | Masuda | 68/202 |
| 4,588,475 | 5/1986 | Lundstrom | 162/205 |
| 4,701,368 | 10/1987 | Kiuchi et al. | 162/901 |
| 4,740,409 | 4/1988 | Lefkowitz | 428/131 |
| 4,888,096 | 12/1989 | Cowan et al. | 162/358 |
| 4,909,905 | 3/1990 | Ilmarinen et al. | 162/360.1 |
| 5,182,164 | 1/1993 | Eklund et al. | 428/234 |
| 5,232,768 | 8/1993 | Eklund et al. | 428/234 |
| 5,256,257 | 10/1993 | Schiel | 162/360.3 |
| 5,298,124 | 3/1994 | Eklund et al. | 162/358.4 |

FOREIGN PATENT DOCUMENTS 86052 12/1986 WIPO .

OTHER PUBLICATIONS

"Mott Porous Media Flow Characteristic", Bulletin–Engineering With Precision Porous Metals, Mott Metalurgical Co., 1983, 1 page.

Douglas Wahren "Recent highlights in paper technology" PAPERMAKING, Tappi Journal , Mar. 1986, pp. 36–45.

Jouness Jaavidaan, William H. Ceckler, and Edward V. Thompson "Rewetting in the expansion side of press nip" Wet Pressing Tappi Journal, Mar. 1988, pp. 151–155.

Richard A. Reese, "How important is sheet rewet after press nips?", WORKSHOP=Papermakers /Corner, Tappi Journal Nov. 1984, pp. 130–131.

*Primary Examiner*—Karen M. Hastings

*Attorney, Agent, or Firm*—Young & Thompson

[57] ABSTRACT

A belt, for a press section, which includes a body portion which is permeable to pressurized gas provided in a press nip and which is substantially impermeable to liquid during passage through the press nip. A press section and method which includes such belt are also provided.

15 Claims, 7 Drawing Sheets

AIR PERMEABLE BELT FOR DEWATERING WEB IN PRESS NIP

BACKGROUND OF THE INVENTION

1. Field of the Invention

The present invention relates to the removal of water from a web or sheet in a pressing operation, and is particularly useful to a belt, and an apparatus and method using such belt, for removal of water from a paper web or sheet in a press section of a papermaking machine. The terms "web" and "sheet" are terms used interchangeably in the papermaking industry and are used interchangeably herein.

2. Description of the Prior Art

The present situation in press dewatering of a paper web or sheet is that while very significant advances have been made in almost every aspect of papermaking, mechanical pressing to remove water from a paper web or sheet has progressed only to a limited extent. At the present time, the removal of water by mechanical wet pressing produces a sheet with a consistency of about 50%, despite the ability to utilize very high press loadings. It is commonly believed that this limitation in the extent to which water can be extracted from the paper web or sheet by mechanical pressing is mainly due to the effect of sheet "rewetting" after the mid-nip. An understanding of press dewatering is useful in understanding sheet rewetting after the mid-nip.

In a typical papermaking operation, the paper sheet is customarily pressed between two press rolls while it is being supported and conveyed on a porous press felt through the nip formed by such press rolls. As the mechanical pressure at the nip compresses the sheet and felt, water is expressed from the sheet into the pore spaces of the felt. Under maximum press load during mid-nip passage; that is, at the middle or mid-point of the press nip where the distance between the two press rolls is at a minimum, a large portion of the water formerly contained within the pore spaces of the sheet is squeezed or expressed from within the sheet and caused to reside within the interface between sheet and press felt, and within the void spaces of the press felt. During post mid-nip passage; that is, immediately upon passing beyond the mid-point of the press nip, the rolls begin to diverge, and in the case of present conditions in wet pressing of paper, a vacuum is created due to the increase in volume between facing pairs of press rolls effected by the expanding nip caused by the divergence of the rolls. As a result of this vacuum, and because the capillaries within the sheet are finer than those within most conventional press felts, the pressure differential caused by the widening nip is filled by air entering from the felt side of the nip. The fact that the felt is a more open substrate relative to the sheet and therefore provides easy egress for air to enter the system also contributes to this condition. As a result of the vacuum being relieved from the felt side rather than from the sheet side of the press nip, the vacuum is present longer adjacent to the sheet surface, allowing a substantial part of the water just expressed from the sheet to reenter the sheet thereby causing an appreciable amount of sheet rewetting after the mid-nip and a decrease in sheet consistency as the sheet leaves the press nip.

Some researchers recognize the desirability of introducing air under modest pressure into the nip, just at the point where the nip starts to open up, to overcome the problem of rewetting after the mid-nip. In particular, it has been reported that 65% dryness in milliseconds at room temperature has been achieved using a press simulator. To this end, a "brief pulse of modestly pressurized air, applied at the mid nip while the sheet is compressed causes the free water to move out of the sheet and into the felt" (*Recent Highlights in Paper Technology*, Douglas Wahren, TAPPI Journal, March 1986). However, heretofore no practical method of introducing air under pressure into a press nip of a papermaking machine press section has been available.

In the processing of wet textile materials, a problem similar to the rewetting problem discussed above exists. Various attempts have been made to increase the dryness of such textile materials beyond that which can be achieved by conventional pressing using pairs of steel rubber or urethane rolls. One such attempt is described in Masuda, U.S. Pat. No. 4,535,611, which relates to the utilization of a system of two cooperating press rolls comprising axially mounted molded fiber web nonwoven porous discs wherein the textile to be dried passes between such two press rolls under pressure. According to Masuda, one of the two press rolls is supplied with a pressurized fluid such as air, and the cooperating press roll is supplied with a vacuum, the first roll serving as a source of air to displace water from the textile fabric, and the vacuum roll serving to remove the expressed liquid from the press roll system. Such a system is not believed to be adaptable to a papermaking operation for several reasons. First, the weak nature of the paper web would make it impossible for the sheet to survive passage into and through a press nip where compressed air was being introduced, without the sheet being destroyed. For example, in a press dewatering step in papermaking, unlike textiles, the paper sheet does not have enough strength to support itself through pairs of press rolls without self destruction caused by forces in operation at the press nip. The unsupported sheet would likely be extruded back out of the nip entryway, particularly when one of the press rolls is forcing air into the nip.

Secondly, the extremely high speeds used in making paper make it impossible to process unsupported wet paper sheets into and through pairs of press rolls as described by Masuda. In particular, in Masuda a bonded fiber web axially compressed nonwoven vacuum roll is provided in direct contact with the textile, to absorb and remove the expressed water. But in the case of paper machines, operating at many times the speed of textile machinery, there would be insufficient time for such a vacuum roll to absorb and convey away the moisture from the press nip. Further, an arrangement similar to that described in Masuda would not prove satisfactory in present day high speed papermaking, because the roll surface would not have time to rid itself of sufficient water before the next revolution of the press roll. Finally, should a vacuum roll be used in combination with the pressurized roll as taught by Masuda, the vacuum roll would cause the sheet to stick to the surface of the roll, and break down, rather than continue to pass through the press nip on to the next step in the papermaking process.

In an effort to reduce rewetting in the manufacture of paper, Lundstrom, U.S. Pat. No. 4,588,475, describes a water impermeable resilient mat which is passed through a press nip next to one side of the sheet while a conventional press felt contacts the opposite side. This mat is stretched as it emerges from the nip to shorten the time that the felt remains in pressure contact with the sheet, thereby reducing the amount of water that can transfer back into the sheet during exit from the nip. This mat is subject to constant stretching and relaxing that may result in early failure. In addition, the effects of shortening the nip length after the mid-nip point may be very limited in terms of its effect on rewetting and sheet moisture content.

Press felts are known which have barrier layers which limit the flow of water therethrough or which provide patterned voids. Press felts are also known which are membrane-like. However, such press felts are permeable to liquid and act as a receptor of water expressed from a wet sheet or web.

One object of the present invention is to provide a belt, for use in a press section, which does not serve as a receptor for liquid expressed from a wet sheet being moved through a press nip in such press section yet allows passage of pressurized gas through the belt into the sheet.

Another object of the present invention is to provide such a belt which pumps air into a wet sheet as the sheet is being moved through a press nip in a press section.

A further object of the present invention is to mix air with water which is present in a sheet as the sheet is being moved through a press nip in a press section to form a momentary froth within the sheet so that less pure water remains in the sheet.

Yet another object of the present invention is to expunge water which is present in a sheet and replace such expunged water with air.

Another object of the present invention is to eliminate post mid-nip vacuum which occurs during conventional dewatering of a sheet as the sheet is moved through a press nip in a press section so that the water once expressed from the sheet does not reenter the sheet.

A further object of the present invention is to improve sheet consistency of a sheet exiting from a press nip in a press section.

Another object of the present invention is to provide a slight burst of air into a sheet at the time that the sheet is under press nip pressure, to displace at least some of the water that resides within the sheet pore spaces.

Yet another object of the present invention is to provide an air pumping belt that will reduce or eliminate the vacuum next to the plain press roll that draws water back into the sheet from the felt by supplanting the vacuum with positive air pressure, to reduce or eliminate sheet rewetting.

A further object of the present invention is to provide a press section and a method which achieves all of the objects of this invention.

SUMMARY OF THE INVENTION

This invention achieves these and other objects by providing a belt for a press section, comprising a first surface, an opposite second surface, and a body portion, the body portion being permeable to pressurized gas and substantially impermeable to liquid. The present invention also relates to an embodiment in which the body portion may comprise a first portion adjacent the first surface and a second portion adjacent the second surface. The first portion will comprise a plurality of gas cavities adjacent and exposed to the first surface, and the second portion will comprise a plurality of passageways. Each passageway will be permeable to pressurized gas, substantially impermeable to liquid, and extend from the second surface to a select cavity. The present invention also relates to an embodiment in which two belts are provided. The second belt may be laminated to the first belt or otherwise made integral with the first belt.

The present invention also provides a press section which includes the belt or belts of the present invention and a method of dewatering a sheet in a press section using such belt or belts.

BRIEF DESCRIPTION OF THE DRAWINGS

This invention may be clearly understood by reference to the attached drawings wherein like elements are designated by like reference numerals and in which.

DESCRIPTION OF THE PREFERRED EMBODIMENT

Figure 1:
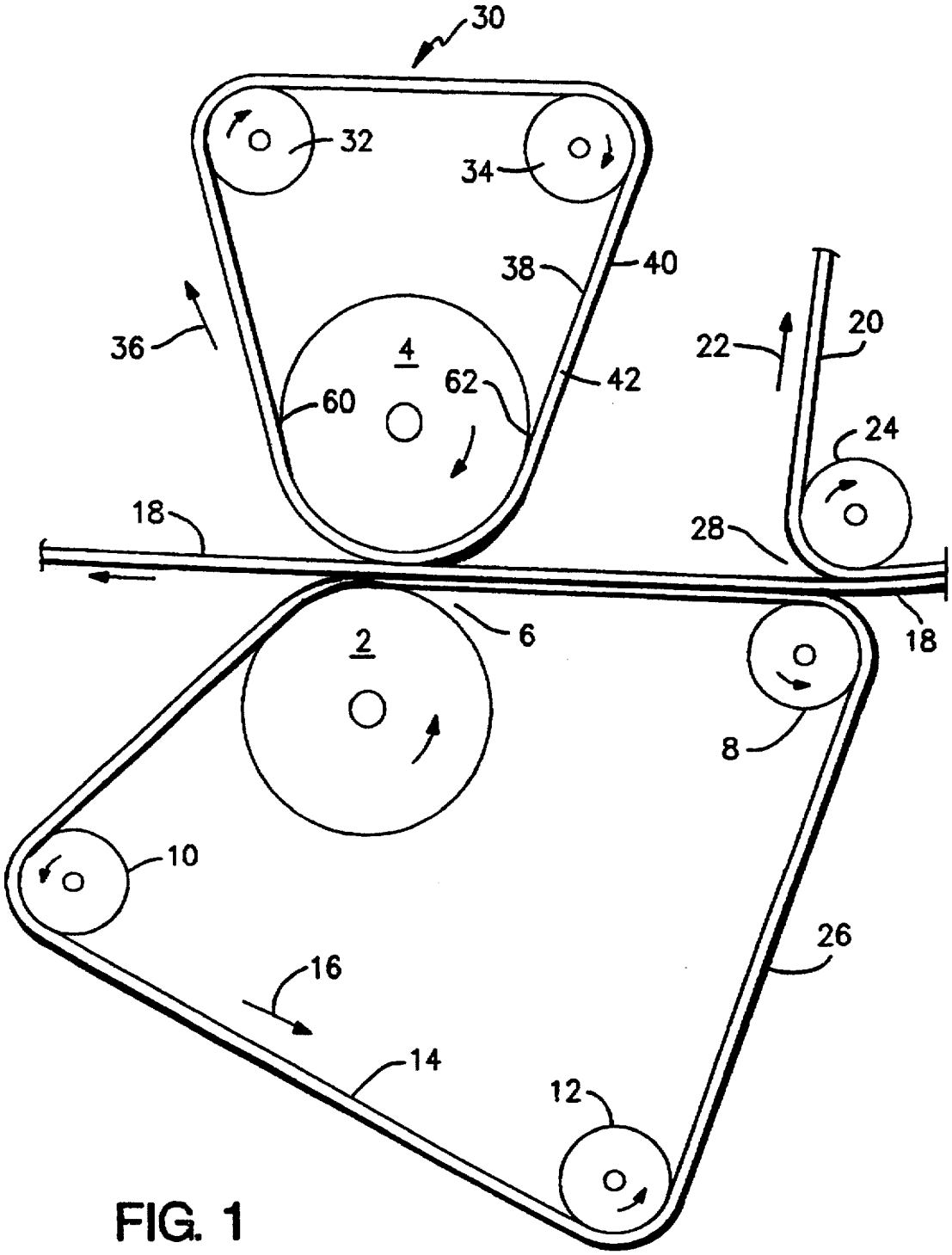
FIG. 1 is a view of a press section embodying the present invention.

The embodiment of this invention which is illustrated in FIG. 1 is particularly suited for achieving the objects of this invention. FIG. 1 depicts a press section of a papermaking machine including a conventional first press roll 2 and a conventional plain second press roll 4 which cooperate to form a press nip 6. Various guide rolls are provided such as guide rolls 8, 10 and 12. It will be apparent to those skilled in the art that more or less guide rolls may be provided if desired. A conventional endless press felt 14 extends about press roll 2 and guide rolls 8,10 and 12 and is caused to travel in the direction 16 in a conventional manner. A sheet or web 18 carried by a conventional upstream endless web-carrying medium 20 travelling in direction 22 around rolls which include, for example, roll 24, is transferred from the medium 20 to a surface 26 of the press felt 14 at a nip 28 provided by rolls 8 and 24 in a conventional manner. Movement of the press felt 14 in the direction 16 causes the press felt 14 to extend, and carry the web 18, through the press nip 6.

A belt is provided which extends through press nip 6, such belt having a first surface, a second surface opposite the first surface for engaging a surface of the web, and a body portion. The body portion is permeable to pressurized gas and substantially impermeable to liquid. For example, in the embodiment depicted in FIG. 1, an air pumping belt 30 is provided which travels through the press nip 6. To this end, guide rolls 32 and 34 are provided. It will be apparent to those skilled in the art that more or less guide rolls may be provided if desired. Belt 30 is an endless conveyor belt-like structure which extends about press roll 4 and guide rolls 32 and 34 and is caused to travel in the direction 36 in a conventional manner. Belt 30 includes a first surface 38 and an opposite second surface 40 which engages web 18. A body portion 42 between surfaces 38 and 40 is permeable to pressurized gas and substantially impermeable to liquid as described in more detail hereinafter.

Figure 2:
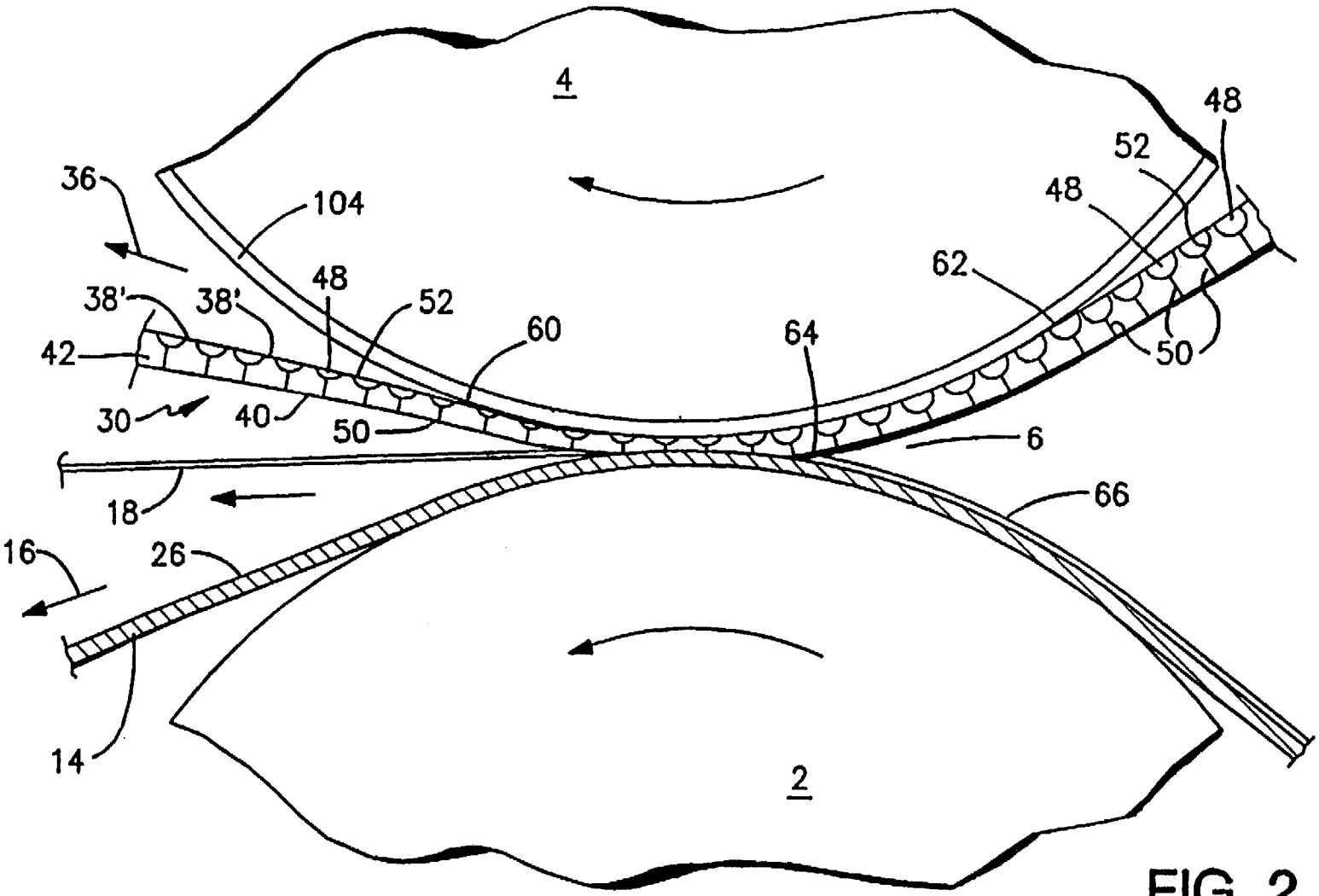
FIG. 2 is an enlarged view of a portion of the press nip of FIG. 1 and a belt of the present invention.
Figure 3:
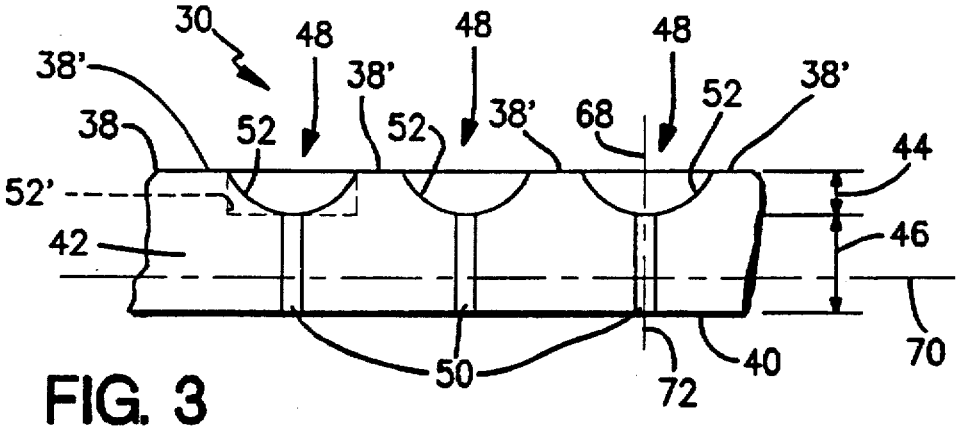
FIG. 3 is a cross-section of the belt of FIG. 4 taken along lines 3—3 and 3'—3'.
Figure 4:
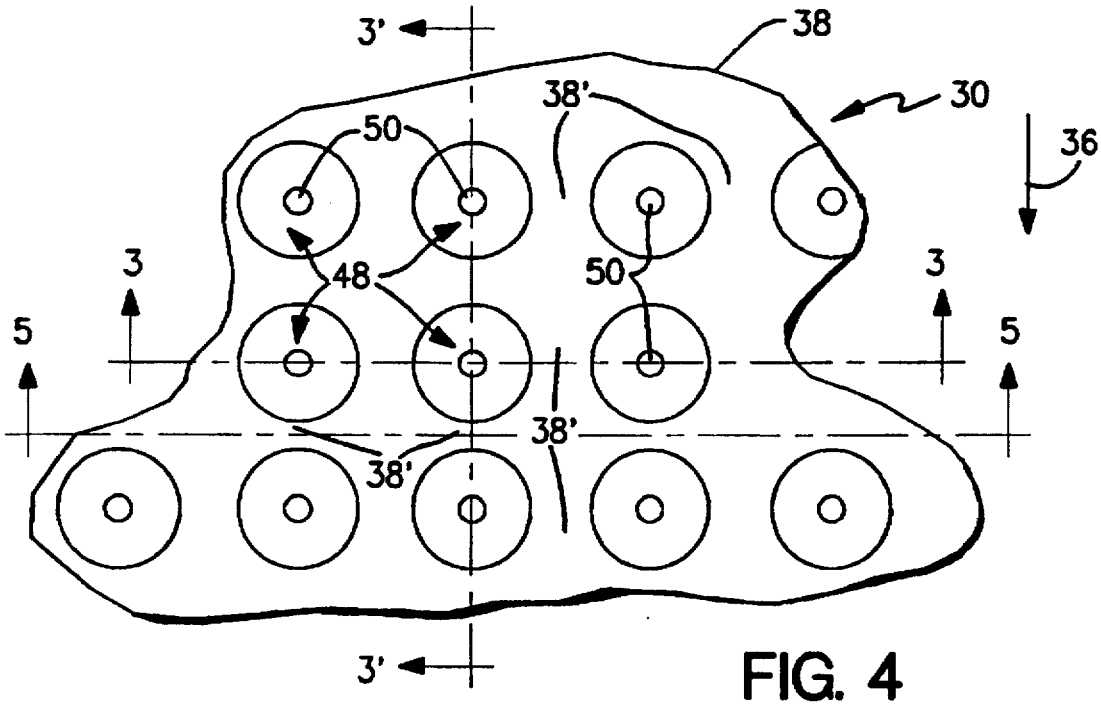
FIG. 4 is a plan view of the belt of FIG. 2 viewed from surface 38.

FIG. 2 is an enlarged view of a portion of the press section depicted in FIG. 1 and includes details of a preferred embodiment of the belt 30 extending through press nip 6. An enlarged partial view of such belt 30 is depicted in FIGS. 3 and 4. As noted, body portion 42 of belt 30 is disposed between a first surface 38 and an opposite second surface 40.

In the embodiment of FIGS. 2 to 4, the body portion 42 comprises a first portion 44 which is adjacent surface 38 and a second portion 46 which is adjacent surface 40. In this embodiment, the portion 44 extends from surface 38 to the portion 46, and the portion 46 extends from the surface 40 to the portion 44. The first portion 44 comprises a plurality of independent air cavities or cells 48 which are adjacent and exposed to the surface 38 for the entire operating length and width of the belt. Without limitation, in the preferred embodiment there will be 5 to 24 cavities 48 per inch of belt length and per inch of belt width. Each cavity 48 is separated from adjacent cavities 48 by a portion 38' of the first surface 38. The second portion 46 comprises a plurality of narrow air passageways 50 in the form of cylindrical bores each of which extends from the second surface 40 to a select cavity 48. Passageways 50 may be in the form of slits or have another configuration if desired. Each passageway 50 is dimensioned to be permeable to pressurized gas and substantially impermeable to liquid. In the embodiment of FIGS. 2 to 4, each select cavity 48 is cup-shaped and comprises a concave wall 52 which extends into portion 44 from the first surface 38 towards the second surface 40. If desired, cavity 48 may be cylindrical, as depicted in phantom line at 52'. Wall 52 is a collapsible resilient wall. To this end, at least the first portion 44 of the body portion may be fabricated from a deformable resilient material such as an elastomeric material. By way of example, such material may be a synthetic elastomer material such as polyurethane plastic. Such materials demonstrate visco-elastic behavior in that they are deformable when subjected to sufficient pressure but do not recover from deformation instantaneously when such pressure is removed but rather show a decided characteristic of delayed elastic recovery. In the embodiment of FIGS. 2 to 4, the entire belt 30 is fabricated from an elastomeric material such as polyurethane plastic. Without limitation, passageways 50 may be 0.030 inches or less in diameter. Therefore, due to the very small diameter of passageways 50 and the deformability of the elastomeric material, passageways 50 will tend to be substantially closed except when the belt 30 is subjected to press nip pressure as described herein. Such air passageways 50 are depicted in the drawings as being open merely to clearly show the existence of a passageway through the belt.

Figure 5:
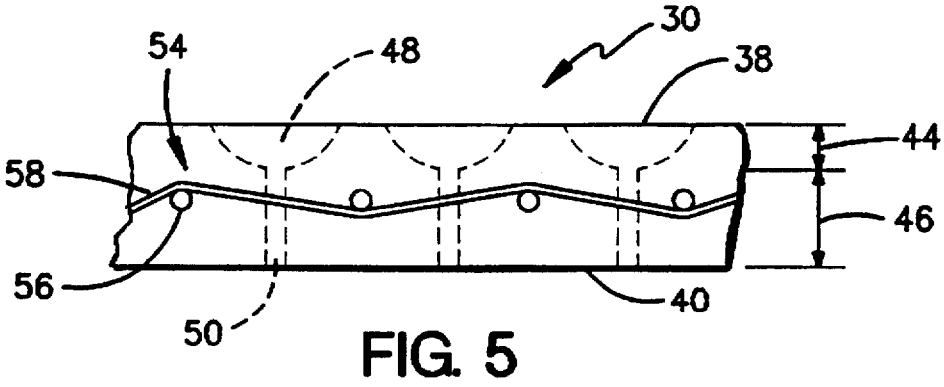
FIG. 5 is a cross section of the belt of FIG. 4 taken in the lengthwise direction of the belt along lines 5—5.

In order to improve the structural stability of the belt 30, a reinforcing member may be embedded within the body portion 42. For example, as depicted in FIG. 5, a woven synthetic fabric 54 may be imbedded within the portion 46 of the belt 30, the fabric warp yarns 56 and fabric weft yarns 58 extending intermediate of the passageways 50 so as not to interfere with the flow of gas therethrough. Alternatively, a non-woven fabric may be embedded within the body portion 42 in place of the woven fabric 54. Other types of reinforcing members may be provided including, without limitation, a series of side by side monofilament yarns and the like. Although the reinforcing member may be disposed anywhere within the body portion 42, in the preferred embodiment the reinforcing member will be disposed near the surface 40 of the belt 30. The use of the reinforcing member provides dimensional stability and prolonged operating life of belt 30.

The hardness of the belt 30 and the configuration and size of the air cavities 48 and air passageway 50 will depend upon the operating condition of the press nip with which the belt is to be used. For example, a specimen for use in a press nip operating at 2000 p.s.i. was fabricated using polyurethane of Shore Durometer A scale 80 (hardness rating). The specimen was 0.2 inches thick and included 5.4 equally spaced air cavities 48 per inch of length and 6.5 equally spaced air cavities 48 per inch of width. Each air cavity 48 was cup-shaped as depicted in FIG. 2 and had a radius of about 0.08 inches. Each air passageway 50 was formed by penetrating the specimen with a needle having a diameter of 0.03 inches. Each air passageway 50 was 0.12 inches long. It will be apparent to those skilled in the art that the foregoing characteristics may be varied so long as the belt functions as described herein.

In considering the operation of the press section depicted in FIGS. 1 and 2, as belt 30 and press felt 14 travel in directions 36 and 16, respectively, successive segments of the belt disengage plain press roll 4 at 60 and the cavities 48 fill with air prior to when such successive portions once again contact the smooth peripheral surface of the plain press roll 4 at 62 as the roll rotates. As each successive segment travels back into contact with the surface of press roll 4 at 62, a seal is effected between the surface of the roll 4 and the portions 38' of the belt 30 which contact such roll surface to thereby entrap air within those cavities 48 surrounded by such roll engaging portions 38'. As a result of such seal, the only remaining escape passageway for such entrapped air is through the narrow passageways 50. A fine spray of water may be directed to the surface of roll 4 to effect a better seal with portions 38', if desired. As the belt 30 enters the press nip 6 at 64, the elastomeric nature of the belt allows it to collapse under press nip pressure causing the entrapped air to pressurize within cavities 48. In particular, walls 52 collapse as the belt 30 travels through the press nip 6 so that the volume of each cavity 48 in the press nip is reduced thereby compressing or pressurizing the air entrapped in such cavities. As the press felt 14 carries web 18 through the press nip, water in the web is first mechanically expressed from the web into voids in the press felt in the conventional manner. No appreciable amount of the water being expressed from the web finds its way into the collapsed air chambers 48 because of the offsetting air pressure therein and because of the very high resistance to liquid passage of the narrow flow restrictive passageways 50. As the belt 30 progresses through the press nip 6, walls 52 will be further collapsed and compressed air will be forced through passageways 50 into the web 18 at web surface 66. The narrow gas passageways 50 leading from air cavities 48 to the web 18 permit the passage of such pressurized air but effectively prevent the flow of water into the belt owing to the combination of high back pressure within cavities 48 and passageways 50, narrow passageways 50, and the very great difference in flow viscosities between air and water. Thus, air under pressure may flow from cavity to web surface, but water is effectively blocked from entering the air pumping belt 30. The rate of flow of pressurized air through passageways 50 can be controlled by, for example, controlling the deformability of the belt 30 and/or the dimensions of the passageways 50. Deformability of belt 30 may be increased or decreased by, for example, decreasing or increasing, respectively, the hardness of the elastomeric material. Generally, by providing a more deformable belt 30 and/or larger passageways 50, a greater rate of flow of pressurized air will be provided as the belt travels through the press nip 6. Similarly, by providing a less deformable belt 30 and/or smaller passageways 50, a smaller rate of flow of pressurized air will be provided as the belt travels through the press nip 6. By controlling the rate of flow of pressurized air through the passageways 50 traveling through press nip 6, it is possible to assure that only some of the entrapped air will release into the web 18 during mid-nip passage of the belt 30, and that some of the pressurized air will be available for release through passageways 50 into the web during post mid-nip passage of the belt through the press nip. As a result, during mid-nip passage compressed air will be caused to burst from passageway 50 into web 18 to drive water out of the web and into the press felt 14 resulting in a mixture of air and water in the web. During post mid-nip passage additional compressed air will be caused to burst from passageways 50 into web 18 to reduce or eliminate the post mid-nip vacuum which will normally occur at the web/press felt interface during exit from the press nip 6. The combined affect is to increase the consistency of web 18. The interval of time during which the belt 30 passes completely around the machine return run prior to re-entry into the press nip 6 is typically about 500 to one thousand times the length of time that the belt remains in the press nip. During this longer time interval, the belt 30 has opportunity to recover substantially all of its original shape and thickness so that cavities 48 once again fill with air and are ready for the next passage through the nip.

Figure 6:
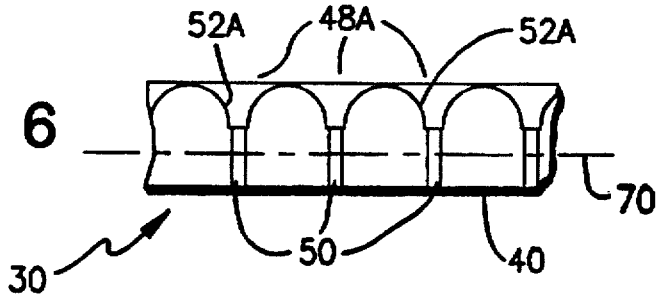
FIGS. 6 to 10 are alternative embodiments of the air cavity 48 of the belt 30 of FIG. 3.
Figure 7:
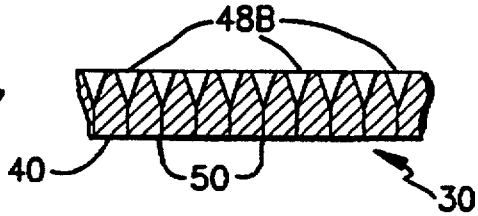
Figure 8:
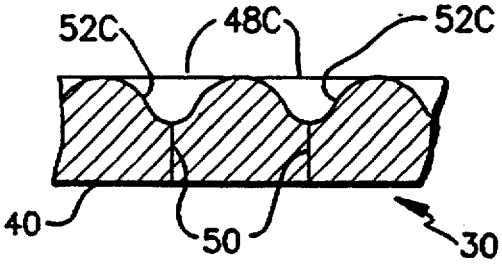
Figure 9:
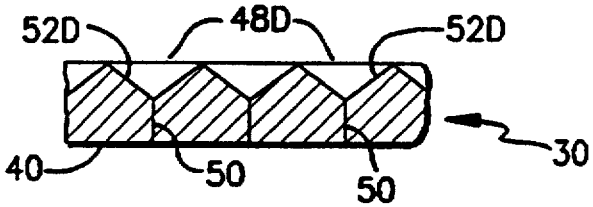

In the embodiment of FIGS. 2 to 4, each cavity 48 is generally cup-shaped and includes an axis 68 which extends at 90° relative to a horizontal plane 70 of the body portion 42, axis 68 being coincident with the axis 72 of an adjacent passageway 50. Without limitation, FIGS. 6 to 9 depict alternative belts which are identical to belt 30 of FIG. 3 with the exception of the configuration of cavity 48, and therefore like elements are designated with like reference numerals. FIGS. 6 to 9 depict cross sections similar to FIG. 3. In FIG. 6, cavities 48A replace cavities 48. Cavities 48A include walls 52A which are convex. In FIG. 7, cavities 48B replace cavities 48. Cavities 48B are conical. In FIG. 8, cavities 48C replace cavities 48. Cavities 48C have undulating surfaces 52C. In FIG. 9, cavities 48D replace cavities 48. Cavities 48D have flat surfaces 52D. Other configurations may be used provided such other configurations form cavities which entrap gas as described herein with respect to cavity 48.

Figure 10:
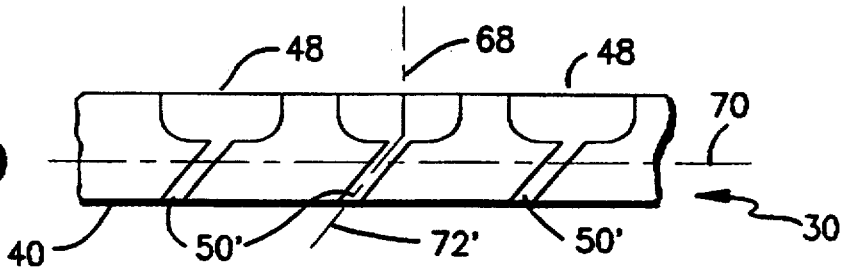

In the embodiments depicted in FIGS. 2 to 9, narrow passageways 50 are provided which are vertically oriented relative to plane 70 along axis 72 as depicted in FIG. 3. In an alternative embodiment, passageways 50 may be oriented at an angle relative to plane 70. For example, FIG. 10 depicts a belt which is identical to belt 30 of FIG. 3 with the exception of the orientation of passageway 50, and therefore like elements are designated with like reference numerals. In the embodiment of FIG. 10, passageways 50' replace passageways 50. Each passageway 50' extends along an axis 72' which is oriented at an angle relative to plane 70 and axis 68 of a respective cavity 48 so that under press nip pressure the flow resistance through each passageway will be further augmented by mechanical press pressure. Passageways 50,50' may be oriented at any angle relative to plane 70 and have any diameter or configuration provided that the passageways function to (a) prevent the entry of water into belt 30, and (b) deter the escape of compressed gas from the cavities in which gas is entrapped until the belt travels into the press nip 6 as described herein. In the preferred embodiment compressed air will not be forced out of cavities 48 or the like until the belt 30 and web 18 are subjected to the significant levels of pressure which exist at mid-nip passage in a press nip.

Figure 12:
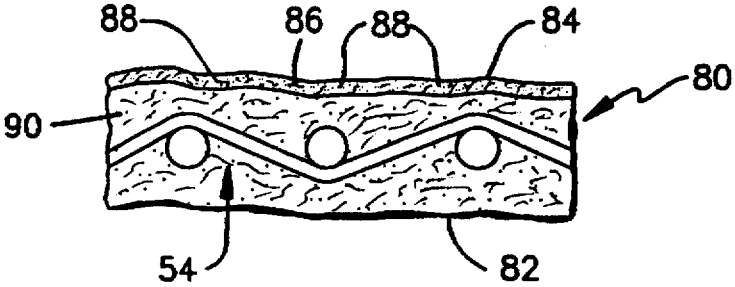
FIG. 12 is a cross-section of the belt of FIG. 11 taken along lines 12—12.
Figure 11:
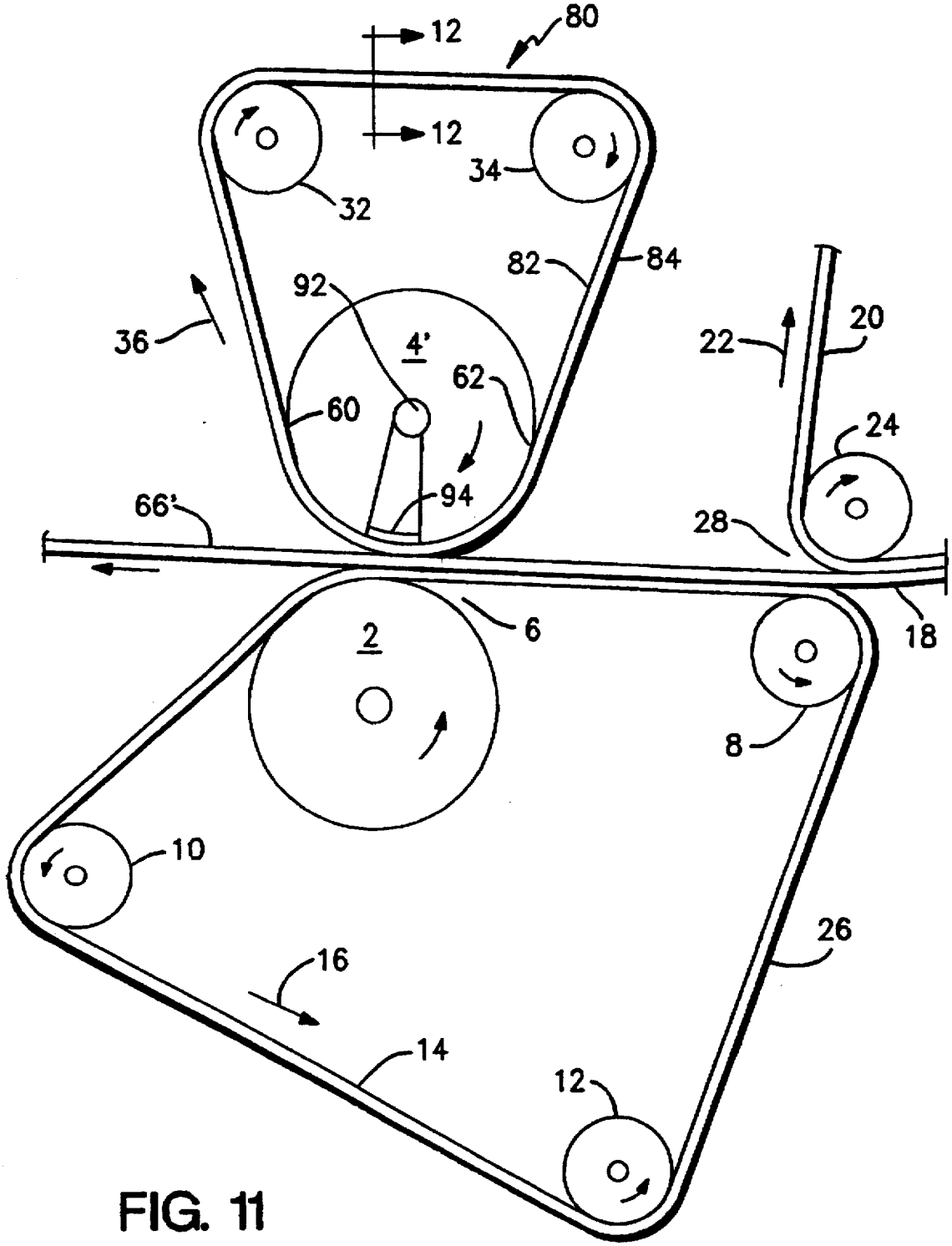
FIG. 11 is a view of an alternative press section embodying the present invention.

In an alternative embodiment, the supply of pressurized air, and the prevention of the flow of water and control of the flow of air in the press nip, can be effected by providing (a) a press roll which is internally pressurized with gas and comprises a portion adjacent the press nip through which the pressurized gas enters the press nip, and (b) an alternative type of belt which engages such pressurized press roll in the press nip and comprises a body portion which is permeable to the pressurized gas and substantially impermeable to liquid. For example, the embodiment of FIG. 11 is identical to the embodiment of FIG. 1 with the exceptions noted herein, and therefore like elements are identified with like reference numerals. In FIG. 11, plain press roll 4 has been replaced with a press roll 4' which is similar to a conventional suction press roll with the exception that rather than withdrawing gas from the roll interior to provide suction through the press roll at the press nip 6, pressurized gas is supplied to the roll interior to provide a flow of pressurized gas through the press roll 4' at the press nip 6. In the embodiment of FIG. 11, belt 30 has been replaced with belt 80. A cross section of belt 80 is depicted in FIG. 12. Belt 80 is a conveyor belt-like structure which includes a press roll contacting surface 82 and an opposite web contacting surface 84. A body portion 86 is adjacent to and coextensive with the surface 84. Body portion 86 is permeable to the pressurized gas supplied by press roll 4' in press nip 6 and substantially impermeable to liquid. In the embodiment of FIG. 12, the body portion 86 is formed by treating surface 84 with resin to partially fill the fibrous surface 84 to the extent that only minute openings 88 are present. By controlling the amount of resin applied, the body portion 86 provides a network of fine fluid flow passageways 88 at surface 84 which act as a manifold to distribute evenly over the entire surface 66 of web 18 the emission of pressurized gas from press roll 4' at press nip 6. The amount of resin applied to surface 84 is controlled such that the body portion 86 will have a very high flow resistance thereby substantially preventing water penetration into the belt 80. In particular, passageways 88 will be provided which are too small for water to flow through in any appreciable amount yet large enough to allow the pressurized gas which will be entrapped in the more open portion 90 of the belt 80 as it passes through the press nip to penetrate the surface 84 at passageways 88 and enter the web 18. Belt 80 may include a reinforcing member such as is described regarding the belt 30 depicted in FIGS. 2 to 5. For example, the belt 80 may include a reinforcing fabric 54 of the type depicted in FIG. 5.

Operation of the press section of FIG. 11 is the same as that of the press section of FIGS. 1 and 2 with the exception that rather than entrapping air in cavities 48 as described herein, pressurized air supplied to roll 4' at air inlet 92 and emitted from roll 4' at a roll portion 94 which is adjacent to press nip 4' will enter belt 80 through surface 82 and be entrapped therein by body portion 86 until the belt is compressed in the press nip 6 sufficiently to force at least some of the gas through passageways 88 and into the web 18. As is the case regarding belt 30, the rate of flow of the pressurized air through passageways 88 can be controlled by, for example, controlling the deformability of the belt 80 and/or the size of passageways 88. Such deformability can be controlled, for example, by controlling the density of the open portion 90. The size of passageways 88 can be controlled, for example, by applying more or less resin to the belt surface.

Figure 13:
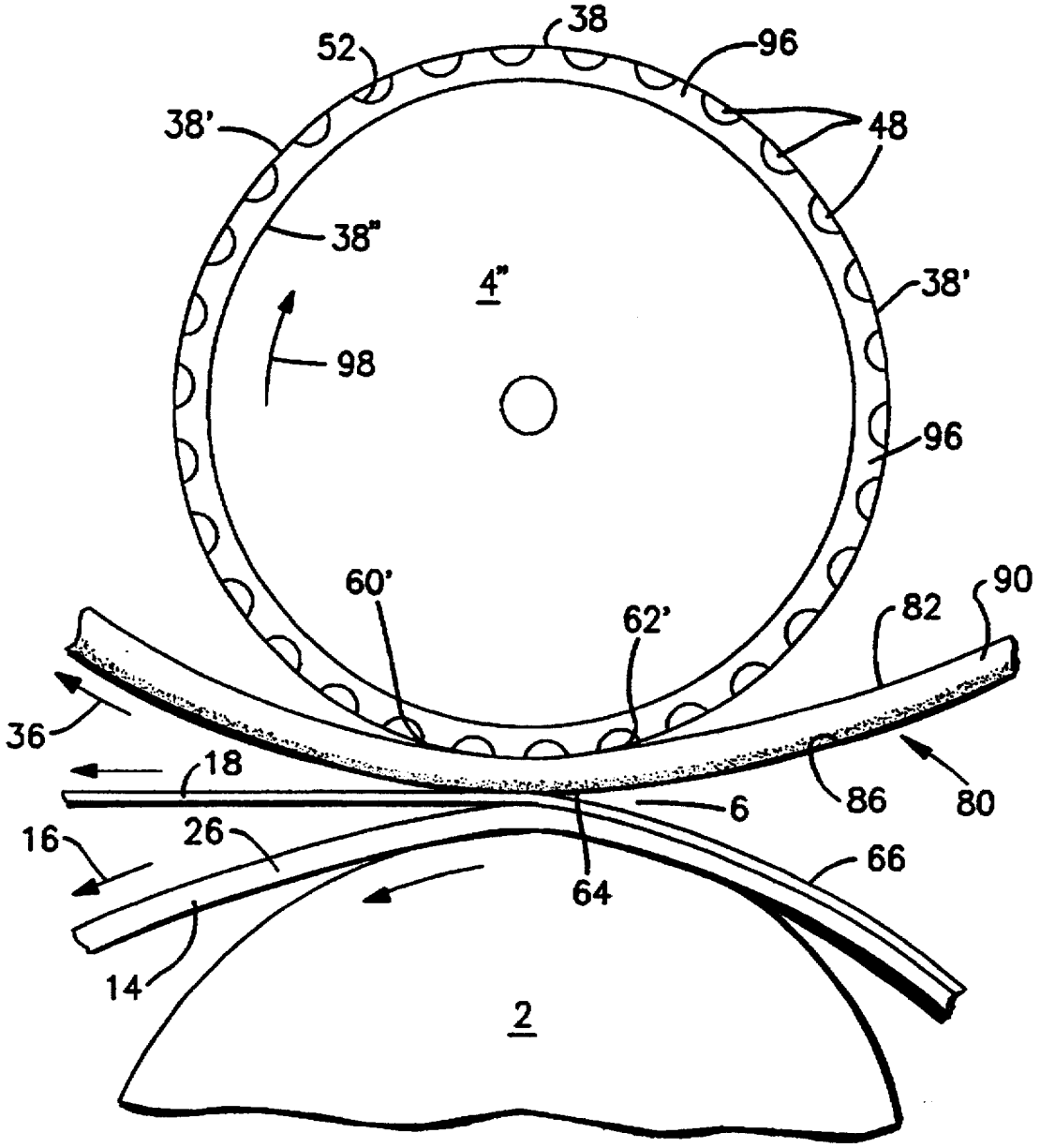
FIG. 13 is a view of a portion of a press nip and belt of an alternative embodiment of the present invention.

An alternative embodiment depicted in FIG. 13 is identical to the embodiment of FIG. 11 with the exception that the pressurized roll 4' has been replaced by a plain press roll 4" which is provided with a roll cover as described herein, and therefore like elements are identified with like reference numerals. In the embodiment of FIG. 13, a belt 96 in the form of a press roll cover is attached to the press roll 4" in a conventional manner. Belt 96 may be a woven or nonwoven structure provided it comprises air cavities which carry gas to press nip 6 and functions to facilitate flow of such gas through belt 80 into web 18 at the press nip. In the preferred embodiment, belt 96 is similar to the portion 44 of belt 30 of FIGS. 2 to 4 with the exceptions that belt 96 includes a roll contacting surface 38" and the cavities 48 face away from the press roll. In particular, belt 96 comprises a plurality of independent air cavities or cells 48 which extend away from press roll 4" and which are adjacent and exposed to belt surface 38. In the preferred embodiment, there will be from 5 to 24 cavities 48 per inch of belt length and per inch of belt width. Each cavity 48 is separated from adjacent cavities 48 by a portion 38' of the surface 38. Each select cavity 48 comprises a concave wall 52 which extends into the belt 96 from the surface 38 towards the press roll 4". Alternative configurations of cavities 48 may be used if desired, such as, for example, the alternative configurations discussed herein. Wall 52 is a collapsible resilient wall. To this end, the belt 96 may be fabricated from the same deformable resilient material discussed herein regarding belt 30.

In considering the operation of the press section depicted in FIG. 13, as roll cover-like belt 96, belt 80, and press felt 14 travel in directions 98, 36 and 16, respectively, successive segments of the belt 80 disengage belt 96 of press roll 4" at 60' and the cavities 48 fill with air prior to when such successive portions once again contact the belt 80 at 62'. As each successive segment of belt 80 travels back into contact with the belt 96 and the belts 80 and 96 enter the press nip 6 at 64, the elastomeric nature of the belt 96 allows it to collapse under press nip pressure causing the air in cavities 48 to pressurize between walls 52 and body portion 86. In particular, walls 52 collapse as the belt 96 travels through the press nip 6 so that the volume of each cavity 48 in the press nip is reduced thereby forcing air into the open portion 90 of belt 80. As the press felt 14 carries web 18 through the press nip, water in the web is first mechanically expressed from the web into voids in the press felt in the conventional manner. None of the water being expressed from the web finds its way into the open portion 90 because of the offsetting air pressure of the air contained between surface 52 and body portion 86 and because of the very high resistance to liquid passage of the flow restrictive passageways 88 of body portion 86. As the belt 96 progresses through the press nip 6, walls 52 will be further collapsed and the compressed air will be forced through passageways 88 into the web 18 at surface 66. The narrow gas passageways 88 permit the passage of such pressurized air but effectively prevent the flow of water into the belt 80 owing to the combination of high back pressure, narrow passageways, and the very great difference in flow viscosities between air and water. The rate of flow of pressurized air through passageways 88 can be controlled as discussed above. As is the case regarding the other embodiments herein, by controlling the rate of flow of pressurized air through the passageways 88 traveling through press nip 6, it is possible to assure that some of the entrapped air will release into the web 18 during mid-nip passage of the belts 80 and 96 and some of the pressurized air will be released through passageways 88 into the web during post mid-nip passage of the belt through the press nip.

Figure 14:
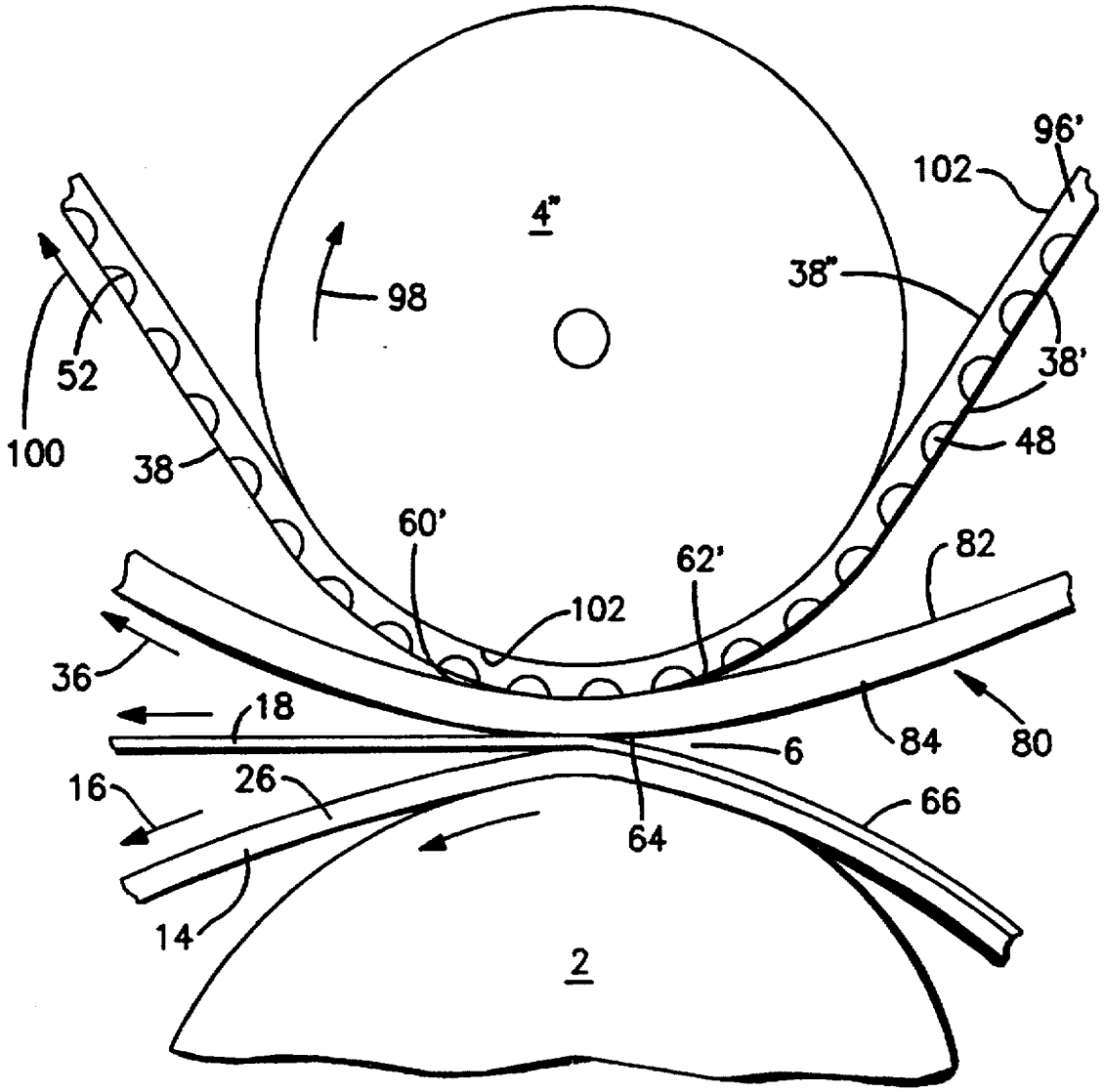
FIG. 14 is a view of a portion of a press nip and belt of an alternative embodiment of the present invention.

An alternative embodiment depicted in FIG. 14 is identical to the embodiment of FIG. 13 except as noted herein, and therefore like elements are identified with like reference numerals. In the embodiment of FIG. 14, the press roll cover-like belt 96 depicted in FIG. 13 has been replaced by a conveyor belt-like belt 96' which is otherwise identical to belt 96. The embodiment of FIG. 14 operates in the same manner described herein regarding the embodiment of FIG. 13 with the exception that rather than rotating with roll 4" as a press roll cover, belt 96' travels in the direction 100 about guide rolls (not shown) similar to guide rolls 32 and 34 depicted in FIG. 1.

In an alternative embodiment, the air cavities of belts 96 and 96' such as, for example, air cavities 48, may extend entirely through each respective belt from surface 38 to surface 38" adjacent press roll 4". In such case, if desired, the belts 96' and 80 may be laminated together to form a unitary structure. Like belt 96 of FIG. 13, alternative configurations of cavities 48 may be used with belt 96' if desired, such as, for example, the alternative configurations discussed herein.

In an alternative embodiment of FIG. 2, roll 4 may optionally include a solid elastomeric roll cover 104. In such embodiment, the segment of the roll cover 104 travelling through the press nip 6 will deform into cavities 48 under the pressure in the press nip to further compress the pressurized gas in such cavities thereby maximizing expulsion of the gas through passageways 50 into web 18.

The embodiments which have been described herein are but some of several which utilize this invention and are set forth here by way of illustration but not of limitation. It is apparent that many other embodiments which will be readily apparent to those skilled in the art may be made without departing materially from the spirit and scope of this invention.

I claim:

1. An endless belt for a press section, consisting essentially of a first surface an opposite second surface, and a body portion, said body portion being permeable to pressurized gas and substantially impermeable to liquid, said body portion having a first portion adjacent said first surface and a second portion adjacent said second surface, said first portion comprising a plurality of air cavities adjacent and exposed to said first surface, and said second portion comprising a plurality of passageways, each passageway of said plurality of passageways being dimensioned to be permeable to pressurized gas and substantially impermeable to liquid, and extending from said second surface to a select air cavity of said plurality of air cavities.

2. The endless belt of claim 1 wherein each select air cavity comprises a collapsible resilient wall which extends from said first surface towards said second surface.

3. The endless belt of claim 2 wherein each air cavity is separated from adjacent air cavities of said plurality of air cavities by a portion of said first surface.

4. The endless belt of claim 1 wherein said belt is formed of an elastomeric material having a reinforcing member embedded therein.

5. A press section comprising:

a first press roll and a second press roll forming a press nip;

a press felt extending through said press nip for carrying a web through said press nip, said press felt having one surface structured and arranged to engage a first side of said web during operation of said press section; and a first endless belt extending through said press nip, said first endless belt consisting essentially of a first surface, a second surface opposite said first surface structured and arranged to engage a second side of said web during operation of said press section and a body portion, said body portion being permeable to pressurized gas and substantially impermeable to liquid, said body portion having a first portion adjacent said first surface and a second portion adjacent said second surface, said first portion comprising a plurality of air cavities adjacent and exposed to said first surface, and said second portion comprising a plurality of passageways, each passageway of said plurality of passageways being dimensioned to be permeable to pressurized gas and substantially impermeable to liquid, and extending from said second surface to a select air cavity of said plurality of air cavities.

6. The press section of claim 5 wherein each air cavity comprises a collapsible resilient wall which extends from said first surface towards said second surface.

7. The press section of claim 6 wherein each air cavity is separated from adjacent air cavities of said plurality of air cavities by a portion of said first surface.

8. The press section of claim 5 wherein said endless belt is formed of an elastomeric material having a reinforcing member embedded therein.

9. The press section of claim 5 wherein said second press roll is internally pressurized with gas and comprises a portion adjacent said press nip through which pressurized gas enters said press nip during operation of said press section.

10. The press section of claim 5, further comprising a second belt extending through said press nip, said second belt having one surface engaging said second press roll, an opposite surface engaging said first surface of said first belt, and a plurality of air cavities adjacent and exposed to said opposite surface.

11. The press section of claim 10 wherein each air cavity of said plurality of air cavities of said second belt comprises a collapsible resilient wall which extends from said opposite surface towards said one surface.

12. The press section of claim 11 wherein each air cavity of said second belt is separated from adjacent air cavities of said plurality of air cavities of said second belt by a portion of said opposite surface.

13. The press section of claim 12 wherein said second belt comprises an elastomeric material.

14. The press section of claim 12 wherein said second belt comprises an elastomeric material having a reinforcing member embedded therein.

15. The press section of claim 5 further comprising a solid elastomeric roll cover attached to said second press roll.

* * * * *